US007158105B2

(12) United States Patent
Miyazawa

(10) Patent No.: US 7,158,105 B2
(45) **Date of Patent: *Jan. 2, 2007**

(54) ELECTRONIC CIRCUIT, METHOD OF DRIVING ELECTRONIC CIRCUIT, ELECTRO-OPTICAL DEVICE, METHOD OF DRIVING ELECTRO-OPTICAL DEVICE, AND ELECTRONIC APPARATUS

(75) Inventor: Takashi Miyazawa, Suwa (JP)

(73) Assignee: Seiko Epson Corporation, Tokyo (JP)

( * ) Notice: Subject to any disclaimer, the term of this patent is extended or adjusted under 35 U.S.C. 154(b) by 365 days.

This patent is subject to a terminal disclaimer.

(21) Appl. No.: 10/647,223

(22) Filed: Aug. 26, 2003

(65) Prior Publication Data

US 2004/0095298 A1 May 20, 2004

(30) Foreign Application Priority Data

Aug. 30, 2002 (JP) ..... 2002-255251
Aug. 12, 2003 (JP) ..... 2003-207375

(51) Int. Cl.
*G09G 3/30* (2006.01)
*G09G 3/14* (2006.01)

(52) U.S. Cl. ..... 345/76; 345/82; 315/169.3

(58) Field of Classification Search ..... 345/76, 345/55, 87, 90, 91, 92, 204, 205, 82; 315/169.3; 257/59, 72

See application file for complete search history.

(56) References Cited

U.S. PATENT DOCUMENTS 5,198,803 A 3/1993 Shie et al.
5,903,246 A 5/1999 Dingwall
5,952,789 A 9/1999 Stewart et al.
6,091,203 A 7/2000 Kawashima et al.
6,229,506 B1 * 5/2001 Dawson et al. ..... 345/82
6,229,508 B1 5/2001 Kane
6,344,850 B1 * 2/2002 Okumura et al. ..... 345/204
6,362,798 B1 3/2002 Kimura et al.
6,501,466 B1 12/2002 Yamagishi et al.
6,683,591 B1 * 1/2004 Hashimoto et al. ..... 345/87
6,750,833 B1 6/2004 Kasai
6,777,888 B1 8/2004 Kondo
6,885,029 B1 * 4/2005 Miyazawa ..... 257/59
2002/0167504 A1 * 11/2002 Matsumoto ..... 345/204
2003/0067424 A1 * 4/2003 Akimoto et al. ..... 345/55
2003/0137503 A1 7/2003 Kimura et al.

FOREIGN PATENT DOCUMENTS

CN 1482586 A 3/2004
EP 1193676 A 4/2002
JP 0-139908 A 6/1991
JP 05-158429 A 6/1993

(Continued)

*Primary Examiner*—Amr A. Awad
*Assistant Examiner*—Stephen G Sherman
(74) *Attorney, Agent, or Firm*—Oliff & Berridge, PLC

(57) ABSTRACT

The present invention provides an electronic circuit, a method of driving the electronic circuit, an electro-optical device, a method of driving the electro-optical device and an electronic apparatus, capable of reducing deviations in threshold voltages of transistors. A pixel circuit can be constructed with three transistors of a driving transistor, an adjusting transistor and a switching transistor, and two capacitors of a first capacitor and a second capacitor. Further, a source of the adjusting transistor can be connected to a voltage supply line for supplying a driving voltage through a control transistor in common with the sources of the adjusting transistors of other pixel circuits, the voltage supply line being provided at the right end side of an active matrix part.

36 Claims, 6 Drawing Sheets

FOREIGN PATENT DOCUMENTS

| | | | |
|---|---|---|---|
| JP | 11-219146 | A | 8/1999 |
| JP | 11-272233 | | 10/1999 |
| JP | 11-272233 | A | 10/1999 |
| JP | 2002-169510 | A | 6/2002 |
| WO | WO 97/05596 | | 2/1997 |
| WO | WO 02/075709 | A1 | 9/2002 |

* cited by examiner

ELECTRONIC CIRCUIT, METHOD OF DRIVING ELECTRONIC CIRCUIT, ELECTRO-OPTICAL DEVICE, METHOD OF DRIVING ELECTRO-OPTICAL DEVICE, AND ELECTRONIC APPARATUS

BACKGROUND OF THE INVENTION

1. Field of Invention

The present invention relates to an electronic circuit, a method of driving the electronic circuit, an electro-optical device, a method of driving the electro-optical device, and an electronic apparatus.

2. Description of Related Art

Recently, highly accurate coloring or enlargement of a screen required for an electro-optical device having a plurality of electro-optical elements, the electro-optical device being widely used as a display device. Corresponding to this, the weight of active-matrix-driven electro-optical devices having a pixel circuit for driving each of the plurality of electro-optical elements has been increased in comparison with passive-matrix-driven electro-optical devices. However, in order to accomplish more highly accurate coloring or further enlargement of the screen, it is necessary to accurately control each of the electro-optical elements. For this purpose, variation in the characteristics of active elements constituting the pixel circuit must be compensated.

As a method of compensating the variation in the characteristics of active elements, for example, a display device (e.g., see Japanese Unexamined Patent Application Publication No. 1999-272233) having pixel circuits including diode-connected transistors in order to compensate the deviation of characteristics has been suggested.

SUMMARY OF THE INVENTION

However, a pixel circuit for compensating the deviation of characteristics of an active element generally has four or more transistors, and as a result, deterioration of the production yield or aperture ratio is caused.

The present invention can solve the above problems, and it is an object of the present invention to provide an electronic circuit, a method of driving the electronic circuit, an electro-optical device, a method of driving the electro-optical device and an electronic apparatus, capable of reducing the number of transistors constituting a pixel circuit or a unit circuit.

A first electronic circuit according to the present invention can have a plurality of unit circuits. Each of the plurality of unit circuits can include a first transistor having a first terminal, a second terminal and a first control terminal, a second transistor having a third terminal, a fourth terminal and a second control terminal, the third terminal being connected to the first control terminal, a capacitive element having a first electrode and a second electrode, the first electrode being connected to the first control terminal, and a third transistor having a fifth terminal and a sixth terminal, the fifth terminal being connected to the second electrode. The fourth terminal can be connected to a first power source line in common with the fourth terminals of other unit circuits of the plurality of unit circuits. The electronic circuit can include a control circuit for setting a potential of the first power source line to a plurality of potentials or controlling electrical disconnection and electrical connection between the first power source line and a driving voltage.

In the electronic circuit described above, the second terminal may be connected to the first power source line, and may be connected to a second power source line other than the first power source line.

A second electronic circuit according to the present invention can have a plurality of unit circuits. Each of the plurality of unit circuits can include a first transistor having a first terminal, a second terminal and a first control terminal, a second transistor having a third terminal, a fourth terminal and a second control terminal, the third terminal being connected to the first control terminal, a capacitive element having a first electrode and a second electrode, the first electrode being connected to the first control terminal, and a third transistor having a fifth terminal and a sixth terminal, the fifth terminal being connected to the second electrode. The fourth terminal can be connected to a first power source line in common with the fourth terminals of other unit circuits of the plurality of unit circuits. The second terminal can be connected to a second power source line. The electronic circuit can include a control circuit for setting a potential of the first power source line to a plurality of potentials or controlling electrical disconnection and electrical connection between the first power source line and a driving voltage.

According to such construction like the electronic circuits described above, the number of transistors constituting the unit circuit can be reduced.

In the electronic circuits described above, it is preferable that the second control terminal is connected to the third terminal. For example, it is preferable that the third terminal and the second control terminal are a drain and a gate, respectively, and thus, the second transistor can be used as a transistor to compensate a threshold voltage of the first transistor.

In the electronic circuits described above, it is preferable that each of the unit circuits does not comprise any other transistor than the first transistor, the second transistor and the third transistor. Using this approach, it is possible to reduce the number of transistors of the unit circuit while compensating the threshold voltage of the first transistor.

In the electronic circuits described above, it is preferable that conductive types of the first transistor and the second transistor are equal to each other. According to such construction, it is possible to easily compensate the threshold voltage of the first transistor by adjusting the threshold voltage of the second transistor.

In the electronic circuits described above, an electronic element may be connected to the first terminal.

In the electronic circuits described above, the electronic element includes, for example, a current-driven element, an electro-optical element, a resistive element, a diode, a memory element or the like.

In the electronic circuits described above, the control circuit can be a fourth transistor having a seventh terminal and an eighth terminal, the seventh terminal is connected to the fourth terminal through the first power source line, and the eighth terminal is connected to the driving voltage. Accordingly, the control circuit can be easily constructed.

In the electronic circuits described above, the second power source line may be also electrically connected to the driving voltage.

In the electronic circuits described above, it is preferable that the threshold voltage of the first transistor is set not to be lower than the threshold voltage of the second transistor. According to such construction as described above, it is possible to surely compensate the threshold voltage of the first transistor.

Further, even when the threshold voltage of the first transistor is compensated by using the second transistor, the first transistor can be set to an electrically disconnected state.

On the contrary, in the electronic circuits described above, the threshold voltage of the first transistor may be set to be equal to or higher than the threshold voltage of the second transistor.

In this case, the second transistor can be switched into an ON state, only by compensating the threshold voltage of the first transistor by using the second transistor.

A third electronic circuit according to the present invention has a plurality of first signal lines, a plurality of second signal lines, a plurality of power source lines and a plurality of unit circuits. Each of the plurality of unit circuits can include a first transistor having a first terminal, a second terminal and a first control terminal, a second transistor having a third terminal, a fourth terminal and a second control terminal, the third terminal being connected to the first control terminal, a capacitive element having a first electrode and a second electrode, the first electrode being connected to the first control terminal, and a third transistor having a fifth terminal and a sixth terminal, the fifth terminal being connected to the second electrode. The second control terminal can be connected to the third terminal, and the third control terminal can be connected to a corresponding first signal line of the plurality of first signal lines.

In the electronic circuit described above, it is preferable that the fourth terminal is connected to a first power source line in common with the fourth terminals of other unit circuits of the plurality of unit circuits, the second terminal is connected to a second power source line. The electronic circuit can include a control circuit for setting a potential of the first power source line to a plurality of potentials or controlling electrical disconnection and electrical connection between the first power source line and a driving voltage.

According to this construction, the number of transistors constituting the unit circuit can be reduced.

In the electronic circuit described above, it is preferable that conductive types of the first transistor and the second transistor are equal to each other. According to this construction, it is possible to easily compensate the threshold voltage of the first transistor by adjusting the threshold voltage of the second transistor.

In the electronic circuit described above, an electronic element may be connected to the first terminal.

In the electronic circuit described above, the electronic element includes, for example, a current-driven element, an electro-optical element, a resistive element, a diode, a memory element or the like.

For the electronic circuit described above, it is preferable that the threshold voltage of the first transistor is set not to be lower than the threshold voltage of the second transistor.

On the contrary, in the electronic circuit described above, the threshold voltage of the first transistor may be set to be equal to or lower than the threshold voltage of the second transistor.

A fourth electronic circuit according to the present invention is an electronic circuit having a plurality of unit circuits. Each of the plurality of unit circuits can include a holding element for holding signal as charge, a switching transistor for controlling transmission of the signal to the holding element, a driving transistor of which an electricallyconductive state is set on the basis of the charge held in the holding element, and an adjusting transistor for setting a control terminal of the driving transistor to a predetermined potential before the transmission of the signal to the holding element. The electronic circuit can include a control circuit for supplying a driving voltage to the adjusting transistors of at least two unit circuits of the plurality of unit circuits.

In the electronic circuit described above, an electronic element may be connected to the driving transistor.

In the electronic circuit described above, the electronic element includes, for example, a current-driven element, an electro-optical element, a resistive element, a diode, a memory element or the like.

A method of driving an electronic circuit according to the present invention is a method of driving an electronic circuit having a plurality of unit circuits. Each of the plurality of unit circuits can include, a first transistor having a first terminal, a second terminal and a first control terminal, a second transistor having a third terminal and a fourth terminal, the third terminal being connected to the first control terminal, and a capacitive element having a first electrode and a second electrode, the first electrode being connected to the first control terminal. The method can include a first step of electrically connecting the respective third terminals of the plurality of unit circuits to a predetermined potential and setting the first control terminals to a first potential, and a second step of varying a potential of the first control terminals from the first potential, by varying a potential of the second electrodes from a second potential to a third potential in a state in which the third terminals are electrically disconnected from the predetermined potential.

According to this method, it is possible to reduce the number of transistors constituting the electronic circuit while compensating the threshold voltage of the first transistor.

In the aforementioned method of driving the electronic circuit, it is preferable that at least for a time required to carry out the first step, the method is carried out in a state in which a potential of the second electrode is set to the second potential.

Furthermore, in the aforementioned method of driving the electronic circuit, electrically connecting the third terminal to a predetermined potential means, for example, a state in which a current is introduced into the third terminal through the fourth terminal, and electrically disconnecting the third terminal from a predetermined potential means, for example, a state in which a current is not introduced through the fourth terminal.

A first electro-optical device according to the present invention is an electro-optical device that can have a plurality of data lines, a plurality of scanning lines and a plurality of unit circuits. Each of the plurality of unit circuits can include a first transistor having a first terminal, a second terminal and a first control terminal, an electro-optical element being connected to the first terminal, a second transistor having a third terminal and a fourth terminal, the third terminal being connected to the first control terminal, a capacitive element having a first electrode and a second electrode, the first electrode being connected to the first control terminal, and a third transistor having a fifth terminal, a sixth terminal and a third control terminal, the fifth terminal being connected to the second electrode. The fourth terminal can be connected to a first power source line in common with the fourth terminals of other unit circuits of the plurality of unit circuits. The third control terminal can be connected to a corresponding scanning line of the plurality of scanning lines. The sixth terminal can be connected to a corresponding data line of the plurality of data lines, the electro-optical device comprising a control circuit for setting a potential of the first power source line to a plurality of potentials or controlling electrical disconnection and electrical connection between the first power source line and a driving voltage.

A second electro-optical device according to the present invention can be an electro-optical device having a plurality of data lines, a plurality of scanning lines and a plurality of unit circuits. Each of the plurality of unit circuits can include a first transistor having a first terminal, a second terminal and a first control terminal, an electro-optical element connected to the first terminal, a second transistor having a third terminal and a fourth terminal, the third terminal being connected to the first control terminal, a capacitive element having a first electrode and a second electrode, the first electrode being connected to the first control terminal, and a third transistor having a fifth terminal, a sixth terminal and a third control terminal, the fifth terminal being connected to the second electrode. The fourth terminal can be connected to a first power source line in common with the fourth terminals of other unit circuits of the plurality of unit circuits, the second terminal can be connected to a second power source line in common with the second terminals of other unit circuits of the plurality of unit circuits, the third control terminal can be connected to a corresponding scanning line of the plurality of scanning lines, and the sixth terminal can be connected to a corresponding data line of the plurality of data lines. The electro-optical device can include a control circuit for setting a potential of the first power source line to a plurality of potentials or controlling electrical disconnection and electrical connection between the first power source line and a driving voltage.

According to the aforementioned electro-optical device, it is possible to reduce the number of transistors constituting a pixel circuit while compensating a threshold voltage of the first transistor.

As a result, the aperture ratio of one pixel is enlarged and the production yield is improved.

In the electro-optical device described above, it is preferable that the second control terminal is connected to the third terminal.

In the electro-optical device described above, the control circuit may be a fourth transistor having a seventh terminal and an eighth terminal, the seventh terminal may be connected to the fourth terminal through the first power source line, and the eighth terminal may be connected to the driving voltage. According to this construction, the control circuit can be simply constructed.

For the electro-optical device described above, it is preferable that each of the unit circuits does not include any other transistor than the first transistor, the second transistor and the third transistor. According to this construction, it is possible to provide an electro-optical device having a high aperture ratio.

In the electro-optical device described above, conductive types of the first transistor and the second transistor are equal to each other. According to this construction, the threshold voltage of the first transistor can be surely compensated.

For the electro-optical device described above, it is preferable that the threshold voltage of the first transistor is set not to be lower than a threshold voltage of the second transistor. Specifically, a gate length of the first transistor may be set not to be shorter than a gate length of the corresponding second transistor in a pixel. Or, a gate insulating film of the first transistor may be not thinner than a gate insulating film of the corresponding second transistor in the pixel. Or, the threshold voltage of the first transistor may be set not to be lower than the threshold voltage of the corresponding second transistor in the pixel by adjusting a concentration of impurities injected into the channel.

It is preferable that the first transistor is operated in a saturated area. According to this construction, it is possible to surely compensate the threshold voltage of the first transistor provided in a pixel circuit. Therefore, it is possible to control a brightness gradation of the electro-optical elements with a high accuracy.

On the contrary, in the aforementioned electro-optical device, the threshold voltage of the first transistor may be set to be equal to or less than the threshold voltage of the second transistor.

In the electro-optical device described above, the second power source line can be also electrically connected to the driving voltage.

In the electro-optical device described above, the electro-optical element is, for example, an EL element.

In the electro-optical device described above, it is preferable that the electro-optical elements having the same color are arranged along the scanning lines.

A method of driving the first electro-optical device according to the present invention can be a method of driving an electro-optical device in which a plurality of unit circuits are arranged correspondingly to intersecting portions of a plurality of scanning lines and a plurality of data lines. Each of the plurality of unit circuits can include a first transistor having a first terminal, a second terminal and a first control terminal, an electro-optical element being connected to the first terminal, a second transistor having a third terminal and a fourth terminal, the third terminal being connected to the first control terminal, and a capacitive element having a first electrode and a second electrode, the first electrode being connected to the first control terminal. The method can include a first step of setting the first control terminals to a first potential by electrically connecting the third terminals of a series of unit circuits including a third transistor of which a third control terminal is connected to one scanning line of the plurality of scanning lines, of the plurality of unit circuits, and a second step of varying a potential of the second electrodes from a second potential to a third potential to vary a potential of the first control terminals from the first potential, by supplying a scanning signal for switching the third transistors into an ON state to the third control terminals of the series of unit circuits to ransistors into ON state and to electrically connect the third transistors to a corresponding data line of the plurality of data lines, and then applying a data signal supplied through the corresponding data line and the third transistors to the second electrodes, wherein in the second step, a time period for applying the data signal to the second electrodes and a time period for electrically disconnecting the third terminals of the series of unit circuits from the predetermined potential are set such that at least parts thereof are overlapped.

A method of driving the second electro-optical device according to the present invention can be a method of driving an electro-optical device in which a plurality of unit circuits are arranged correspondingly to intersecting portions of a plurality of scanning lines and a plurality of data lines. Each of the plurality of unit circuits can include a first transistor having a first terminal, a second terminal and a first control terminal, an electro-optical element being connected to the first terminal, a second transistor having a third terminal and a fourth terminal, the third terminal being connected to the first control terminal, and a capacitive element having a first electrode and a second electrode, the first electrode being connected to the first control terminal. The fourth terminals of a series of unit circuits including a third transistor of which a third control terminal can be connected to one scanning line of the plurality of scanning lines, of the plurality of unit circuits, are all connected to one first power source line of a plurality of first power source lines. The method can include a first step of setting the first control terminals to a first potential by electrically connecting the fourth terminals of the series of unit circuits to a predetermined potential, and a second step of varying a potential of the second electrodes from a second potential to a third potential to vary a potential of the first control terminals from the first potential, by supplying a scanning signal for switching the third transistors into an ON state to the third control terminals of the series of unit circuits to switch the third transistors into ON state and electrically connect the third transistors to a corresponding data line of the plurality of data lines, and then applying a data signal supplied through the corresponding data line and the third transistors to the second electrodes, wherein in the second step, a time period for applying the data signal to the second electrodes and a time period for electrically disconnecting the fourth terminals of the series of unit circuits from the predetermined potential are set such that at least parts thereof are overlapped.

In the aforementioned method of driving an electro-optical device, it is preferable that at least for a time required to carry out the first step, the method is carried out in a state in which a potential of the second electrode is set to the second potential. Thereby, the potential of the first control terminal can be accurately set to a potential corresponding to the data signal.

A first electronic apparatus according to the present invention is equipped with the aforementioned electronic circuit.

A second electronic apparatus according to the present invention is equipped with the aforementioned electro-optical device.

In the aforementioned invention, the first transistor and the driving transistor, the first and second terminals, and the first control terminal and the control terminal of the driving transistor correspond to, for example, a driving transistor Trd, a drain and a source of the driving transistor Trd, and a gate of the driving transistor Trd, respectively, in a pixel circuit 20 shown in FIG. 3 of a first embodiment to be described in greater detail below.

Further, the second transistor and the adjusting transistor, the third and fourth terminals, and the second control terminal correspond to, for example, an adjusting transistor Trc, a drain and a source of the adjusting transistor Trc, and a gate of the adjusting transistor Trc, respectively, in the pixel circuit 20 shown in FIG. 3 of the first embodiment.

Furthermore, the third transistor, the fifth terminal, the sixth terminal and the third control terminal correspond to, for example, a switching transistor Trs, a source (a terminal connected to a capacitor C1) of the switching transistor Trs, a drain (a terminal connected to a data line Xm) of the switching transistor Trs and a gate of the switching transistor Trs, respectively, in the pixel circuit 20 shown in FIG. 3 of the first embodiment.

BRIEF DESCRIPTION OF THE DRAWINGS

The invention will be described with reference to the accompanying drawings, wherein like numerals reference like elements, and wherein.

DETAILED DESCRIPTION OF PREFERRED EMBODIMENTS

Figure 1:
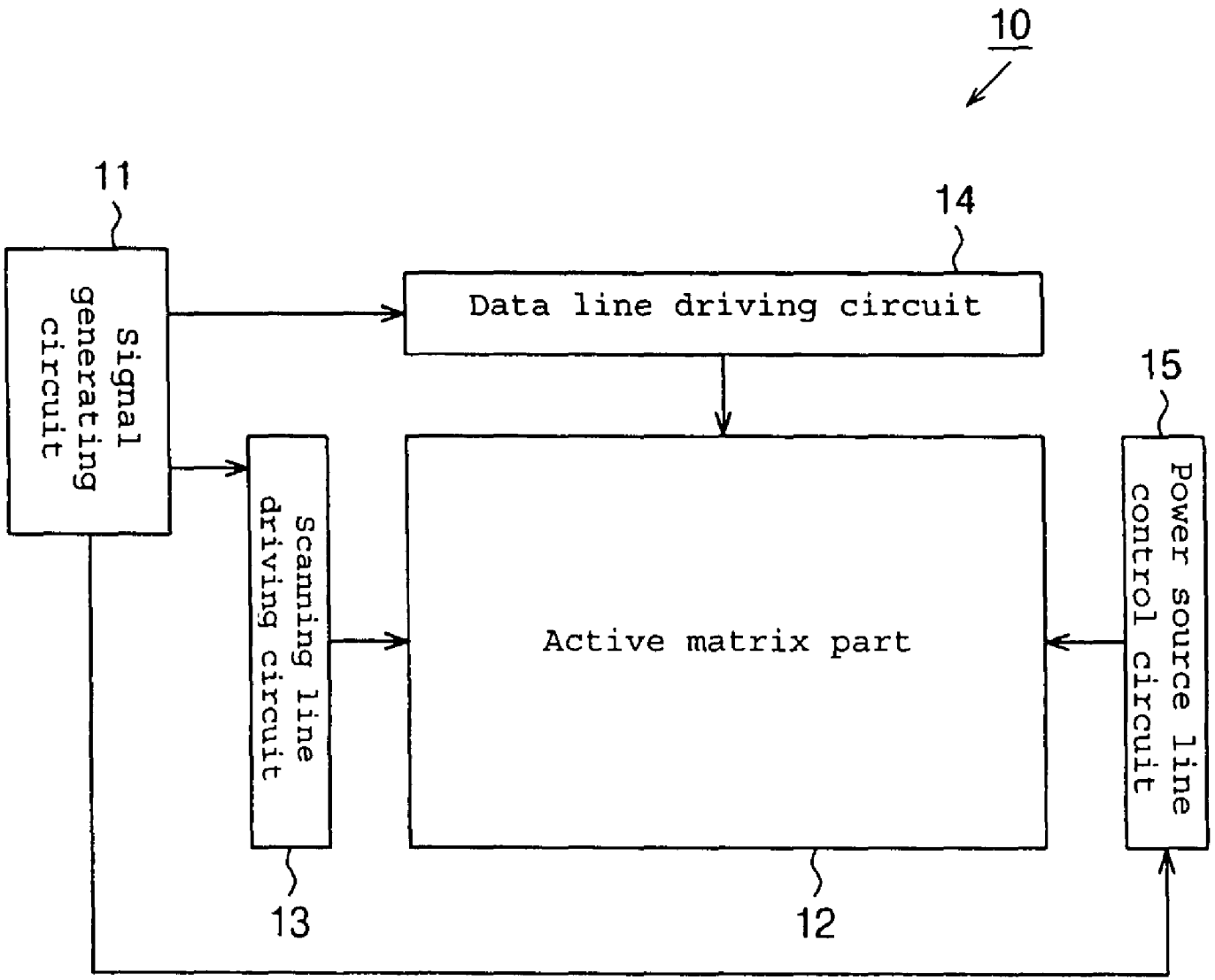
FIG. 1 is an exemplary circuitry block diagram illustrating a circuit configuration of an organic EL display device according to the present embodiment.
Figure 2:
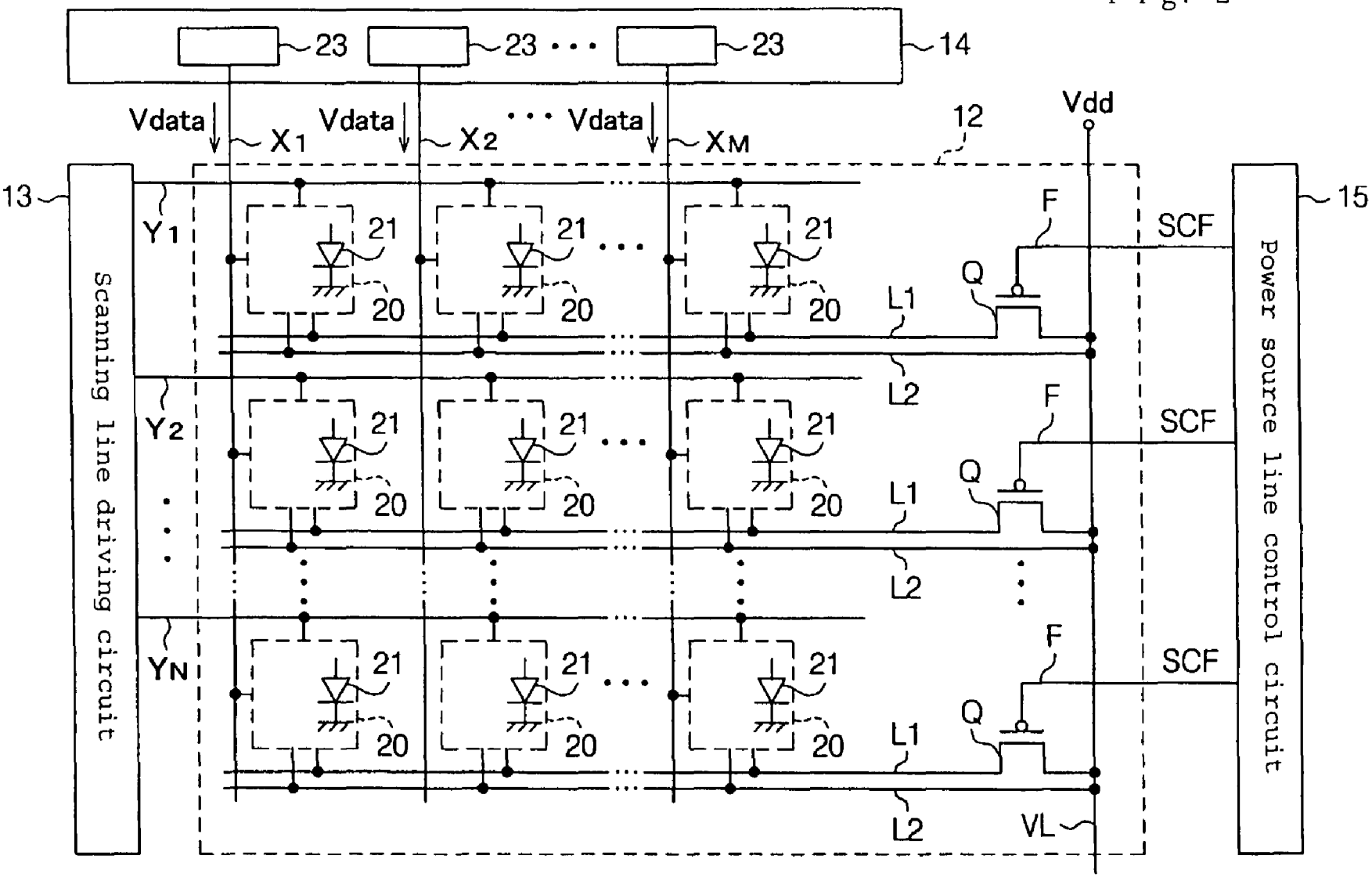
FIG. 2 is an exemplary circuitry block diagram illustrating an internal circuit configuration of an active matrix part and a data line driving circuit according to a first embodiment.
Figure 3:
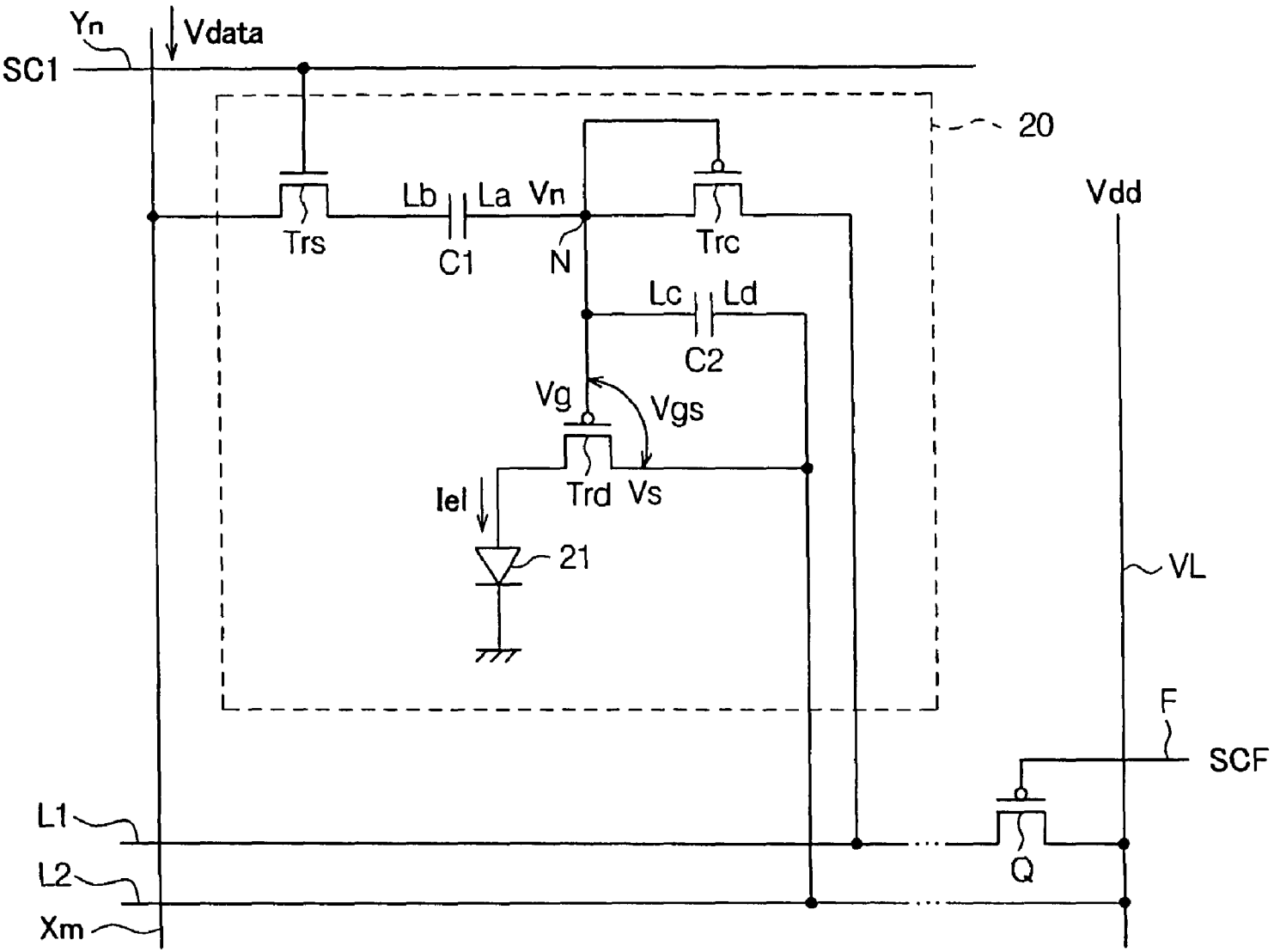
FIG. 3 is an exemplary circuit diagram of a pixel circuit according to the first embodiment.
Figure 4:
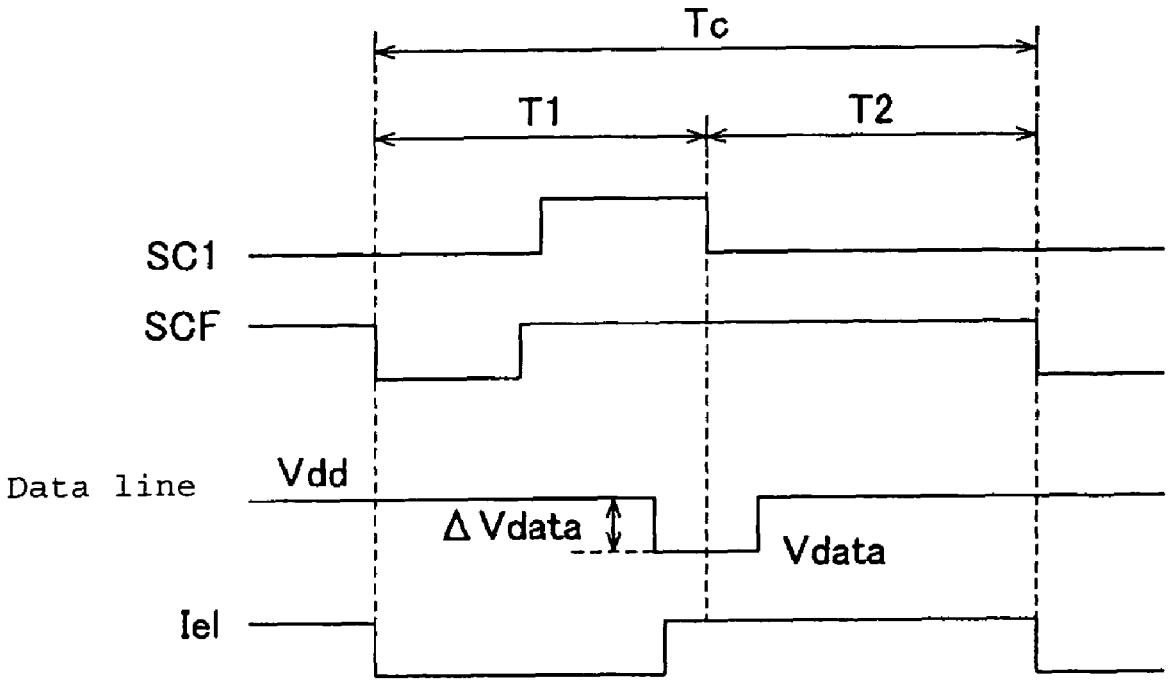
FIG. 4 is an exemplary timing chart for explaining a method of driving a pixel circuit according to the first embodiment.

Now, a first embodiment of the present invention will be described with reference to FIGS. 1 to 4. FIG. 1 is an exemplary circuitry block diagram illustrating a circuit configuration of an organic EL display device as an electro-optical device. FIG. 2 is an exemplary circuitry block diagram illustrating an internal circuit configuration of an active matrix part and a data line driving circuit. FIG. 3 is an exemplary circuit diagram of a pixel circuit. FIG. 4 is an exemplary timing chart for explaining a method of driving a pixel circuit.

An organic EL display device 10 can include, as shown in FIG. 1, a signal generating circuit 11, an active matrix part 12, a scanning line driving circuit 13, a data line driving circuit 14 and a power source line control circuit 15.

The signal generating circuit 11, the scanning line driving circuit 13, the data line driving circuit 14 and the power source line control circuit 15 of the organic EL display device 10 may be constructed with an independent electronic component, respectively. For example, the signal generating circuit 11, the scanning line driving circuit 13, the data line driving circuit 14 and the power source line control circuit 15 may be constructed with one chip of semiconductor integrated circuit device, respectively. In addition, all or a part of the signal generating circuit 11, the scanning line driving circuit 13, the data line driving circuit 14 and the power source line control circuit 15 may be constructed with a programmable IC chip, and the functions thereof may be executed in software by programs written in the IC chip.

The signal generating circuit 11 generates a scanning control signal and a data control signal for displaying images in the active matrix part 12 on the basis of image data from an external device not shown. Further, the signal generating circuit 11 outputs the scanning control signal to the scanning line driving circuit 13 and outputs the data control signal to the data line driving circuit 14. Furthermore, the signal generating circuit 11 outputs a timing control signal to the power source line control circuit 15.

The active matrix part 12, as shown in FIG. 2, has an electronic circuit in which pixel circuits 20 as a plurality of unit circuits having organic EL elements 21 as electronic elements or electro-optical elements, light-emitting layers of which are made of organic materials are arranged in a matrix shape. That is, the pixel circuits 20 are arranged at positions corresponding to the intersecting portions of M data lines Xm (m=1 to M; m is an integer) extending in a column direction and N scanning lines Yn (n=1 to N; n is an integer) extending in a row direction.

Further, the respective pixel circuits 20 are connected to first power source lines L1 and second power source lines L2 extending in the row direction. The first and second power source lines L1, L2 are connected to a voltage supply line VL extending in the column direction of the pixel circuits 20 provided at the right end side of the active matrix part 12, respectively. Furthermore, transistors to be described in greater detail below which are disposed in the pixel circuits 20 generally comprise TFTs (Thin Film Transistors).

The scanning line driving circuit 13 selects one scanning line of the N scanning lines Yn provided in the active matrix part 12 on the basis of the scanning control signal generated from the signal generating circuit 11, and then supplies a scanning signal to the selected scanning line.

The data line driving circuit 14 has a plurality of single line drivers 23. Each of the single line drivers 23 is connected to a corresponding data line Xm provided in the active matrix part 12. The respective line drivers 23 generate a data voltage Vdata as a signal on the basis of the data control signal generated from the signal generating circuit 11. In addition, the single line drivers 23 output the generated data voltage Vdata to the pixel circuits 20 through the data line Xm. In the pixel circuits 20, the internal conditions of the corresponding pixel circuits 20 are established in accordance with the output data voltage Vdata, so that a driving current Iel (refer to FIG. 3) flowing in the respective organic EL elements 21 becomes controlled so as to make the brightness gradation of the organic EL elements 21 controlled. Furthermore, each of the single line drivers 23 of the data line driving circuit 14 supplies a bias voltage having the same potential as a driving voltage Vdd supplied from a voltage supply line VL before supplying the data voltage Vdata to the respective pixel circuits 20, for a data writing time period T1 to be described in greater detail below.

The power source line control circuit 15 is connected to gates of control transistors Q to be described later through power source line control lines F. The power source line control circuit 15 generates and supplies a power source line control signal for switching the control transistors Q into an ON state, for a time period of complete or partial overlapping with the scanning signals, on the basis of the timing control signal output from the signal generating circuit 11. Further, when the control transistors Q are switched into the ON state, the driving voltage Vdd is supplied to the respective pixel circuits 20 through the first power source lines L1.

Next, the pixel circuits 20 constituting the active matrix part 12 of the organic EL display device 10 constructed in the above manner will be described below. Further, since the circuit configurations of the respective pixel circuits 20 are similar to each other, one pixel circuit will be described for the purpose of convenience of explanation.

As shown in FIG. 3, a pixel circuit 20 has three transistors and two capacitors. Specifically, the pixel circuit 20 includes, as shown in FIG. 3, a driving transistor Trd, an adjusting transistor Trc and a switching transistor Trs. Furthermore, the pixel circuit 20 can include a first capacitor C1 and a second capacitor C2 as a capacitive element or a holding element.

Conductive types of the driving transistor Trd, the adjusting transistor Trc and the control transistor Q are a p type (p channel), respectively. In addition, a conductive type of the switching transistor Trs is an n type (n channel).

A drain of the driving transistor Trd is connected to an anode (positive electrode) of the organic EL element 21. A cathode (negative electrode) of the organic EL element 21 is grounded. A source of the driving transistor Trd is connected to the second power source lines L2. The second power source line L2 is connected to the voltage supply line VL supplying the driving voltage Vdd as a driving voltage. A gate of the driving transistor Trd is connected to a first electrode La of the first capacitor C1, a drain of the adjusting transistor Trc and a third electrode Lc of the second capacitor C1. A capacitance of the first capacitor C1 is Ca, and a capacitance of the second capacitor C2 is Cb.

A second electrode Lb of the first capacitor C1 is connected to a source of the switching transistor Trs. A drain of the switching transistor Trs is connected to the data line Xm. Furthermore, a gate of the switching transistor Trs is connected to the scanning line Yn.

The gate and the drain of the adjusting transistor Trc are connected at a node N. The source of the adjusting transistor Trc is connected to the first power source line L1 in common with the sources of other adjusting transistors Trc provided in other pixel circuits 20. The first power source line L1 is connected to the voltage supply line VL provided at the right end side of the active matrix part 12 through the control transistor Q. Specifically, a drain as a seventh terminal of the control transistor Q is connected to the first power source line L1. A source as a eighth terminal of the control transistor Q is connected to the voltage supply line VL. Furthermore, the gate of the control transistor Q is connected to the power source line control line F. The power source line control line F is connected to the power source line control circuit 15.

The power source line control circuit 15 supplies a power source line control signal SCF for controlling the electrically conductive state of the control transistor Q through the power source line control line F. In addition, when the power source line control signal SCF switching the control transistor Q into an ON state is output from the power source line control circuit 15, the control transistor Q is switched into the ON state. As a result, the driving voltage Vdd is applied to the source of the adjusting transistor Trc.

A fourth electrode Ld of the second capacitor C2 is connected to the second power source line L2 in common with the source of the driving transistor Trd.

In this embodiment, the adjusting transistor Trc is formed such that a threshold voltage Vth2 thereof is substantially equal to a threshold voltage Vth1 of the driving transistor Trd. Further, the driving voltage Vdd is set to be sufficiently higher than the data voltage Vdata.

Next, a method of driving the pixel circuits 20 of the organic EL display device 10 constructed in the above manner will be described with reference to FIG. 4. Further, in FIG. 4, Tc, T1 and T2 denote a driving cycle, a data-writing period and a light-emitting period, respectively. The driving cycle Tc comprises the data-writing period T1 and the light-emitting period T2. The driving cycle Tc means a cycle in which the brightness gradation of the organic EL elements 21 are updated, and in this embodiment, corresponds to a frame.

First, for the data-writing period T1, when the switching transistor Trs is in an OFF state, the power source line control signal SCF for switching the control transistor Q into an ON state is output from the power source line control circuit 15 through the power source line control line F. Thereby, the control transistor Q is switched into the ON state, and as a result, the driving voltage Vdd is output to the first power source line L1 to which the control transistor Q is connected.

By doing so, a potential of the source of the adjusting transistor Trc is set to the driving voltage Vdd, and a potential of the gate thereof, that is, a potential Vn of the node N is set to a voltage (Vn=Vdd−Vth2) obtained by subtracting the threshold voltage (Vth2) of the adjusting transistor Trc from the driving voltage Vdd. Further, the potential Vn is held as an initial potential Vc1 in the first capacitor C1 and the second capacitor C2, and is supplied to the gate of the driving transistor Trd.

Furthermore, at that time, a scanning signal SC1 for switching the switching transistor Trs into the OFF state has been supplied to the gate of the switching transistor Trs through the scanning line Yn from the scanning line driving circuit 13, and thus the switching transistor Trs is in the OFF state.

Thereafter, the power source line control signal SCF for switching the control transistor Q into the OFF state is output from the power source line control circuit 15 through the power source line control line F, the control transistor Q is thus switched into the OFF state, and the source of the adjusting transistor Trc is electrically disconnected from the power source line control circuit 15. As a result, the drain of the adjusting transistor Trc is electrically disconnected from the driving voltage Vdd, that is, is switched into a floating state.

Subsequently, the scanning signal SC1 for switching the switching transistor Trs into the ON state is supplied to the gate of the switching transistor Trs through the scanning line Yn from the scanning line driving circuit 13, and thus the switching transistor Trs is in the on state.

For the time period in which the switching transistor Trs is in the on state, the data voltage Vdata is supplied to the pixel circuit 20 through the data line Xm and the switching transistor Trs from the data line driving circuit 14.

Thereby, the initial potential Vc1 is converted into a value expressed by the following equation, using a capacitance Ca of the first capacitor C1 and a capacitance Cb of the second capacitor C2.

$$Vc1=Vdd-Vth2+Ca/(Ca+Cb)\cdot\Delta V\text{data}$$

Here, ΔVdata is a potential difference (=Vdd−Vdata) between the driving voltage Vdd and the data voltage Vdata. Further, Vdd−Vth2+Ca/(Ca+Cb)·ΔVdata is supplied as a final potential Vc2 to the gate of the driving transistor Trd.

In accordance with the final potential Vc2, the electrically conductive state of the driving transistor Trd is established, and the driving current Iel corresponding to the electrically conductive state is supplied to the organic EL element 21. The current Iel is expressed as follows, when a voltage difference between a gate voltage Vg and a source voltage Vs of the driving transistor Trd is put to Vgs.

$$Iel=(1/2)\beta(-Vgs-Vth1)^2$$

Here, β is a gain coefficient, and the gain coefficient becomes β=(μAW/L), when a mobility of carrier is put to μ, a capacity of gate is put to A, a channel width is put to W and a channel length is put to L. Further, the gate voltage Vg of the driving transistor Trd is the final potential Vc2. That is, the voltage difference Vgs between the gate voltage Vg and the source voltage Vs of the driving transistor Trd is expressed as follows.

$$Vgs=Vdd-[Vdd-Vth2+Ca/(Ca+Cb)\cdot\Delta V\text{data}]$$

Therefore, the driving current Iel of the driving transistor Trd is expressed as follows.

$$Iel=(1/2)\beta[Vth2-Ca/(Ca+Cb)\cdot\Delta V\text{data}-Vth1]^2$$

Here, since the threshold voltage Vth2 of the adjusting transistor Trc is set to be substantially equal to the threshold voltage Vth1 of the driving transistor Trd as described above, the driving current Iel is expressed as follows.

$$\begin{aligned} Iel &= (1/2)\beta[Vth2-Ca/(Ca+Cb)\cdot\Delta Vdata-Vth1]^2 \\ &= (1/2)\beta[Ca/(Ca+Cb)\cdot\Delta Vdata]^2 \end{aligned}$$

Therefore, as expressed by the above equation, the driving current Iel has an amount corresponding to the data voltage Vdata, not depending upon the threshold voltage Vth1 of the driving transistor Trd. Thus, the driving current Iel is supplied to the organic EL element 21 and the organic EL element 21 emits light.

Next, for a light-emitting period T2 after the data-writing period T1, the scanning signal SC1 for switching the switching transistor Trs into the OFF state is supplied to the gate of the switching transistor Trs through the scanning line Yn from the scanning line driving circuit 13. As a result, the switching transistor Trs is switched into the OFF state.

For this light-emitting period T2, the driving current Iel due to the electrically conductive state of the driving transistor Trd set in accordance with the final potential Vc2 is supplied to the organic EL element 21.

Thereby, even when the threshold voltage Vth1 of the driving transistor Trd of each pixel circuit 20 is different from others due to a manufacture deviation, the driving current Iel is determined from the data voltage Vdata. For this reason, the brightness gradation of the organic EL element 21 is controlled with a high accuracy on the basis of the data voltage Vdata.

Moreover, it is possible to reduce the number of transistors constituting one pixel circuit 20 and in addition, to compensate the manufacture deviation. Therefore, according to this pixel circuit 20, it is possible to provide the organic EL display device 10 capable of making the yield or the aperture ratio improved, as well as to control the brightness gradation of the organic EL element 21 with a high accuracy.

Furthermore, it is preferable that the transistors constituting one pixel circuit 20 are made of, for example, any one of mono-crystalline silicon, poly-crystalline silicon, fine-crystalline silicon or amorphous silicon.

Next, a second embodiment according to the present invention will be described with reference to FIG. 5. Further, in this embodiment, constructional members similar to those of the first embodiment denote the same reference numerals respectively as those in the first embodiment, and the detailed description thereof will be omitted.

Figure 5:
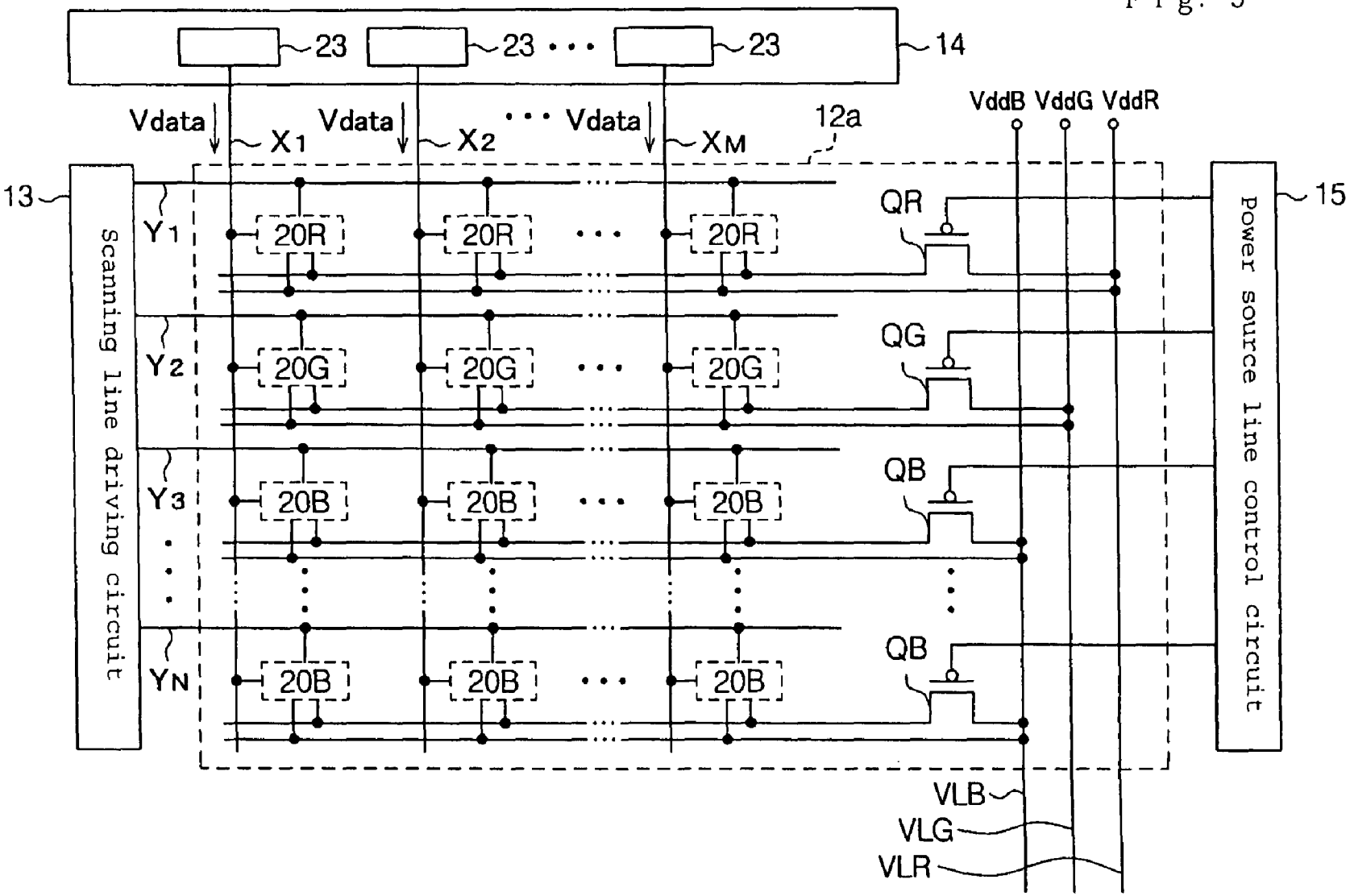
FIG. 5 is an exemplary circuitry block diagram illustrating an internal circuit configuration of an active matrix part and a data line driving circuit according to a second embodiment.

FIG. 5 is an exemplary circuitry block diagram illustrating an internal circuit configuration of an active matrix part 12*a* and a data line driving circuit 14 of an organic EL display device 10. In this embodiment, the active matrix part 12*a* can include red pixel circuits 20R having organic EL elements 21 emitting red light, green pixel circuits 20G having organic EL elements 21 emitting green light and blue pixel circuits 20B having organic EL elements 21 emitting blue light. The circuit configurations of the aforementioned red, green and blue pixel circuits 20R, 20G, 20B are the same as the circuit configuration of the pixel circuits 20 described in the first embodiment.

Specifically, the pixel circuits 20R, 20G, 20B having the same color are arranged in a direction in which the scanning lines Yn extends in the active matrix part 12*a*. That is, the red pixel circuits 20R are connected to the first scanning line Y1 of the scanning lines Yn. Similarly, the green pixel circuits 20G are connected to the second scanning line Y2 of the scanning lines Yn.

Similarly, the blue pixel circuits 20B are connected to the third scanning line Y3 of the scanning lines Yn. Further, each of the pixel circuits 20R, 20G, 20B is successively arranged in the column direction, and then repeated. Furthermore, the control transistors QR, QG, QB respectively corresponding to the color pixel circuits 20R, 20G, 20B are connected to the voltage supply lines VLR, VLG, VLB for supplying the driving voltages VddR, VddG, VddB corresponding to the color pixel circuits 20R, 20G, 20B, respectively.

Next, a method of driving the pixel circuits 20R, 20G, 20B of the organic EL display device 10 constructed in the above described manner will be explained.

A scanning signal for switching the switching transistor Trs into an OFF state is supplied through the scanning line Y1, and for a time period in which the switching transistor Trs in one red pixel circuit 20R arranged in a direction in which the scanning line Y1 extends is in the OFF state, a signal for switching the control transistor QR corresponding to the scanning line Y1 into an ON state is output from the power source line control circuit 15. As a result, a potential Vn (=Vdd−Vth2) is held as the initial potential Vc1 in the first capacitor C1 and the second capacitor C2 included in each of red pixel circuits 20R connected to the scanning line Y1.

Thereafter, a scanning signal for switching the control transistor QR into the OFF state is supplied from the power source line control circuit 15, and further a scanning signal for switching the switching transistor Trs into the ON state is supplied from the power source line control circuit 15 through the scanning line Y1. In this state, a data voltage Vdata is supplied to the pixel circuit 20 through the data line Xm and the switching transistor Trs from the single line driver 23 of the data line driving circuit 14.

Thereby, the initial potential Vc1 is converted into a value expressed by the following equation, using the capacitance Ca of the first capacitor C1 and the capacitance Cb of the second capacitor C2.

$$Vc1=Vdd-Vth2+Ca/(Ca+Cb)\cdot\Delta V\text{data}$$

Furthermore, Vc1 is supplied as the final potential Vc2 to the gate of the driving transistor Trd.

In accordance with the final potential Vc2, an electrically conductive state of the driving transistor Trd is established, and a driving current Iel corresponding to the electrically conductive state is supplied to the organic El element 21.

As a result, the organic EL element 21 of the red pixel circuit 20R emits light. At that time, the threshold voltage Vth2 of the adjusting transistor Trc has been set to be substantially equal to the threshold voltage Vth1 of the driving transistor Trd. Therefore, since the threshold voltage Vth1 of the respective driving transistors Trd of the red pixel circuits 20R is compensated, brightness gradation of the organic EL element 21 of the red pixel circuit 20R is controlled with a high accuracy in accordance with the data voltage Vdata.

Subsequently, in a state in which the switching transistor Trs included in the green pixel circuit 20G corresponding to the scanning line Y2 is switched into the OFF state, a signal for switching the control transistor QG into the ON state is output from the power source line control circuit 15. As a result, a potential Vn (=Vdd−Vth2) is held as the initial potential Vc1 in the first capacitor C1 and the second capacitor C2 included in each green pixel circuit 20G connected to the scanning line Y2.

Thereafter, a scanning signal for switching the control transistor QG into the OFF state is supplied from the power source line control circuit 15, and further a scanning signal for switching the switching transistor Trs into the ON state is supplied from the power source line control circuit 15 through the scanning line Y2. Accordingly, the data voltage Vdata is supplied through the data line Xm from the single line driver 23 of the data line driving circuit 14.

Thereby, the initial potential Vc1 is converted into a value expressed by the following equation, using the capacitance Ca of the first capacitor C1 and the capacitance Cb of the second capacitor C2.

$$Vc1=Vdd-Vth2+Ca/(Ca+Cb)\cdot\Delta V\text{data}$$

Furthermore, this Vc1 is supplied as the final potential Vc2 to the gate of the driving transistor Trd.

In accordance with the final potential Vc2, the electrically conductive state of the driving transistor Trd is established, and a driving current Iel corresponding to the electrically conductive state is supplied to the organic EL element 21.

As a result, the organic EL element 21 of the green pixel circuit 20G emits light. At that time, a threshold voltage Vth2 of the adjusting transistor Trc is set to be substantially equal to the threshold voltage Vth1 of the driving transistor Trd. Therefore, since the threshold voltage Vth1 of the respective driving transistors Trd of the green pixel circuits 20G is compensated, the brightness gradation of the organic EL element 21 of the green pixel circuit 20G is controlled with a high accuracy in accordance with the data voltage Vdata.

Then, the same operation is carried out for the blue pixel circuits 20B provided correspondingly to the scanning line Y3.

In general, as the material characteristics of the organic EL elements 21 may differ due to a color of emitted light, there may be a case where it is necessary to set a driving voltage for every color of emitted light. In such a case, the panel layout like that described in the second embodiment is suitable.

Furthermore, when the driving voltage is varied due to deterioration with ageor the like of the organic EL elements for every color of emitted light, it is possible to compensate deterioration with age of the organic EL elements by properly resetting the driving voltage Vdd in accordance with the extent of deterioration with age of the organic EL elements.

Of course, the concept of the aforementioned embodiment can be applied to electronic elements or electro-optical elements other than the organic EL elements.

Next, applications of the organic EL display device 10 as the electro-optical device described in the first and second embodiments to electronic apparatuses will be described with reference to FIGS. 6 and 7. The organic EL display device 10 can be applied to a variety of electronic apparatuses such as a mobile personal computer, a portable phone, a digital camera or the like.

Figure 6:
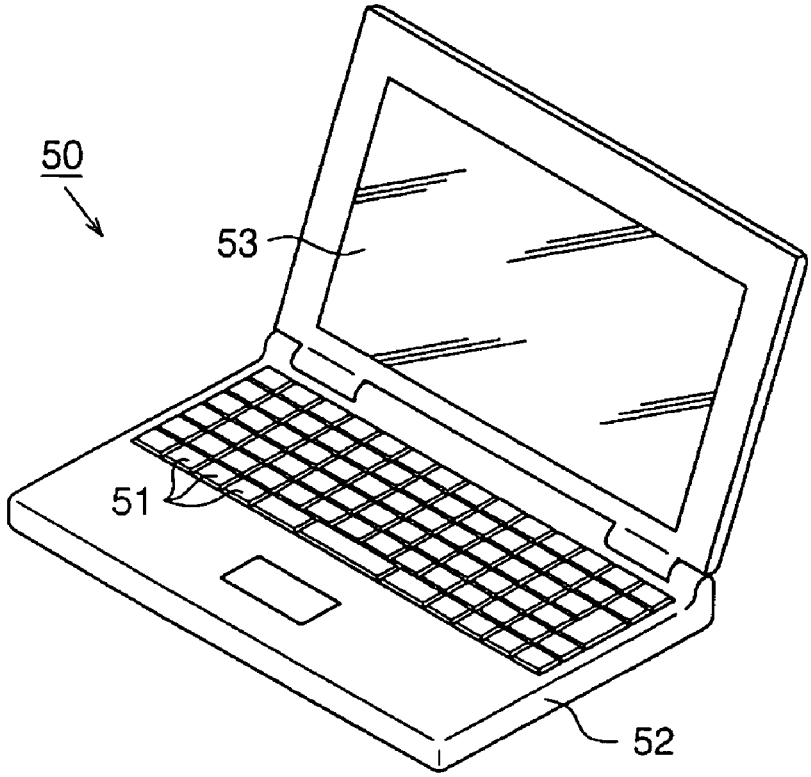
FIG. 6 is a perspective view illustrating a construction of a mobile personal computer for explaining a third embodiment.

FIG. 6 is a perspective view illustrating a construction of a mobile personal computer. In FIG. 6, the personal computer 50 can include a main body part 52 having a keyboard 51, and a display unit 53 using the organic EL display device 10. In this case, the display unit 53 using the organic EL display device 10 has advantages similar to those of the aforementioned embodiments. As a result, it is possible to provide the mobile personal computer 50 comprising the organic EL display device 10 capable of controlling a brightness gradation of the organic EL elements 21 with a high accuracy and enhancing an yield or an aperture ratio thereof.

Figure 7:
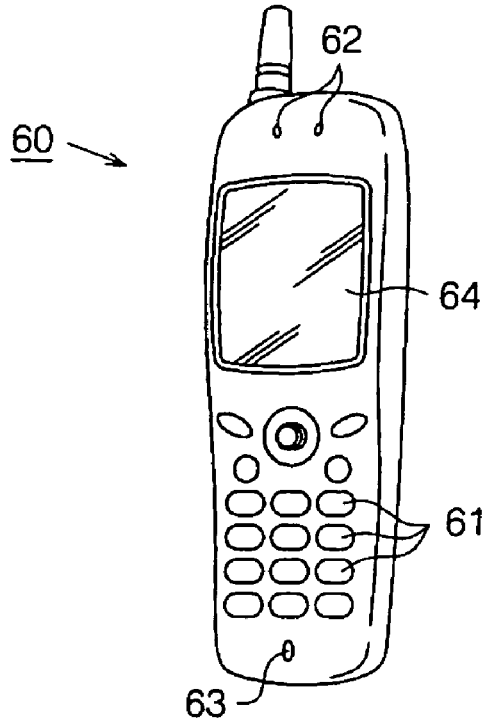
FIG. 7 is a perspective view illustrating a construction of a portable phone for explaining the third embodiment.

FIG. 7 is a perspective view illustrating a construction of a portable phone. In FIG. 7, the portable phone 60 can include a plurality of manipulation buttons 61, a receiver 62, a transmitter 63 and a display unit 64 using the organic EL display device 10. Further, in this case, the display unit 64 using the organic EL display device 10 has advantages similar to those of the aforementioned embodiments. As a result, it is possible to provide the portable phone 60 comprising the organic EL display device 10 capable of controlling a brightness gradation of the organic EL elements 21 with a high accuracy and enhancing an yield or an aperture ratio thereof.

Furthermore, it should be understood that embodiments of the present invention are not limited to the embodiments described above, but may be implemented as follows.

In the aforementioned embodiments, the control transistor Q is used as a control circuit. In addition, in place of the transistor Q, a switch capable of switching between a low potential and a high potential may be provided. Furthermore, a buffer circuit or a voltage follower circuit including a source follower circuit may be used to improve the driving ability of the driving transistor Trd. By doing so, it is possible to rapidly supply current to the pixel circuits.

Although the control transistor Q and the voltage supply line VL are provided at the right end side of the active matrix part 12 in the embodiments described above, the control transistor Q and the voltage supply line VL may be provided in the power source control circuit 15.

The voltage supply line VL may be provided at the same side of the active matrix part 12 as the scanning line driving circuit 13.

The power source line control circuit 15 may be provided at the same side of the active matrix part 12 as the scanning line driving circuit 13.

In the embodiments described above, the conductive type of the driving transistor Trd, the adjusting transistor Trc and the control transistor Q is put to a p type, and the conductive type of the switching transistor Trs is put to an n type. On the contrary, the conductive type of the driving transistor Trd and the adjusting transistor Trc may be put to an n type, and the conductive type of the switching transistor Trs and the control transistor Q may be put to a p type.

Also, the conductive type of the overall transistors described above may be put to the same type.

Although it is described in the aforementioned embodiments that the present invention applies to the organic EL elements, it should be understood that the present invention may be embodied in unit circuits for driving a variety of electro-optical elements such as LEDs, FEDs, liquid crystal elements, inorganic EL elements, electrophoresis elements, electron emitting elements or the like, in addition to the organic EL elements. The present invention may be embodied in memory elements, such as RAMs (specifically, MRAMs) or the like.

What is claimed is:

1. An electronic circuit comprising:

a plurality of unit circuits;

a first power source line; and a control circuit that sets a potential of the first power source line to a plurality of potentials or controls an electrical disconnection and an electrical connection between the first power source line and a predetermined voltage, each of the plurality of unit circuits including:

a first transistor having a first terminal, a second terminal, and a first control terminal;

a second transistor having a third terminal, a fourth terminal, and a second control terminal, the third terminal being coupled to the first control terminal, and the fourth terminal being directly connected to the first power source line;

a capacitive element having a first electrode and a second electrode, the first electrode being coupled to the first control terminal; and a third transistor having a fifth terminal and a sixth terminal, the third transistor controlling an electrical connection between a data line and the second electrode, and an electrically conductive state of the first transistor being set during at least a part of a first period in which the data line is electrically connected, to the second electrode through the third transistor.

2. The electronic circuit according to claim 1, further comprising a second power source line that is coupled to the second terminal.

3. The electronic circuit according to claim 2, the second power source line being set to the predetermined voltage.

4. The electronic circuit according to claim 1, the second control terminal being coupled to the third terminal.

5. The electronic circuit according to claim 1, each unit circuit of the plurality of unit circuits not including any transistor other than the first transistor, the second transistor, and the third transistor.

6. The electronic circuit according to claim 1, a conduction type of the first transistor being identical with a conduction type of the second transistor.

7. The electronic circuit according to claim 1, each of the plurality of unit circuits further including an electronic element coupled to the first terminal.

8. The electronic circuit according to claim 7, the electronic element being a current-driven element.

9. The electronic circuit according to claim 7, a driving voltage and a driving current whose levels correspond to the electrically conductive state of the first transistor are supplied to the electronic element during a second period.

10. The electronic circuit according to claim 1, the control circuit being a fourth transistor having a seventh terminal and an eighth terminal.

11. The electronic circuit according to claim 1, a threshold voltage of the first transistor not being lower than a threshold voltage of the second transistor.

12. An electronic apparatus being equipped with the electronic circuit according to claim 1.

13. An electronic circuit comprising:

a plurality of first signal lines;

a plurality of second signal lines;

a plurality of first power source lines;

a control circuit that sets a potential of each of the plurality of first power source lines to a plurality of potentials or controls an electrical disconnection and an electrical connection between one first power source line of the plurality of first power source lines and a predetermined voltage; and a plurality of unit circuits, each of the plurality of unit circuits including:

a first transistor having a first terminal, a second terminal, and a first control terminal;

a second transistor having a third terminal, a fourth terminal, and a second control terminal, the third terminal being coupled to the first control terminal, and the fourth terminal being directly connected to the first power source line;

a capacitive element having a first electrode and a second electrode, the first electrode being coupled to the first control terminal; and a third transistor having a fifth terminal, a sixth terminal, and a third control terminal, the third transistor controlling an electrical connection between the second electrode and one second signal line of the plurality of second signal lines, the third control terminal being coupled to one first signal line of the plurality of first signal lines, and an electrically conductive state of the first transistor being determined during at least a part of a period in which the one second signal line is electrically connected to the second electrode through the third transistor.

14. The electronic circuit according to claim 13, further comprising a plurality of second power source lines one of which is coupled to the second terminal.

15. The electronic circuit according to claim 13, a conduction type of the first transistor being identical with a conduction type of the second transistor.

16. The electronic circuit according to claim 13, each of the plurality of unit circuits further including an electronic element that is coupled to the first terminal.

17. The electronic circuit according to claim 13, the plurality of first power source lines intersecting the plurality of second signal lines.

18. An electronic circuit comprising:

a first signal line;

a second signal line;

a power source line; and a plurality of unit circuits, each of the plurality of unit circuits including:

a first transistor having a first terminal, a second terminal, and a first control terminal;

a second transistor having a third terminal that is coupled to the first control terminal and a fourth terminal that is directly connected to the power source line;

a capacitive element having a first electrode and a second electrode, the first electrode being coupled to the first control terminal; and a third transistor having a fifth terminal that is coupled to the second electrode, a sixth terminal that is coupled to the second signal line, and a third control terminal that is coupled to the first signal line, a first potential of the first electrode being set to a first voltage by electrically connecting the first electrode and the power source line through the second transistor during a first period, and a second potential of the first control terminal being set to a second voltage by a data signal that is supplied to the capacitive element through the third transistor during a second period and that changes the first potential from the first voltage by a capacitance coupling involved with the capacitive element.

19. The electronic circuit according to claim 18, each of the plurality of unit circuits further including an electronic element that is coupled to the first transistor.

20. The electronic circuit according to claim 18, further comprising:

a control circuit that sets a potential of the power source line to a plurality of potentials or controls an electrical disconnection and an electrical connection between the power source line and a predetermined voltage.

21. The electronic circuit according to claim 18, each unit circuit of the plurality of unit circuits not including any transistor other than the first transistor, the second transistor, and the third transistor.

22. An electro-optical device, the device comprising:

a plurality of data lines;

a plurality of scanning lines;

a plurality of first power source lines;

a control circuit that sets each of the plurality of first power source lines to a plurality of potentials or that controls electrical connection and disconnection between each of the plurality of first power source lines and a predetermined voltage; and a plurality of unit circuits, each of the plurality of unit circuits including:

a first transistor having a first terminal, a second terminal, and a first control terminal;

an electro-optical element that is coupled to the first terminal;

a second transistor having a third terminal and a fourth terminal the third terminal being coupled to the first control terminal, and the fourth terminal being directly connected to one first power source line of the plurality of first power source lines;

a capacitive element having a first electrode and a second electrode, the first electrode being coupled to the first control terminal; and a third transistor having a fifth terminal that is coupled to the second electrode, a sixth terminal that is coupled to one data line of the plurality of data lines, and a third control terminal that is coupled to one scanning line of the plurality of scanning lines, and an electrically conductive state of the first transistor being determined during at least a part of a period in which the one data line is electrically connected to the second electrode through the third transistor.

23. The electro-optical device according to claim 22, further comprising a plurality of second power source lines, and the second terminal being coupled to one second power source line of the plurality of second power source lines.

24. The electro-optical device according to claim 23, the one second power source line being coupled to the predetermined voltage.

25. The electro-optical device according to claim 22, the second control terminal being coupled to the third terminal.

26. The electro-optical device according to claim 22, the control circuit being a fourth transistor having a seventh terminal and an eighth terminal, the seventh terminal being coupled to the fourth terminal through one first power source line of the plurality of first power source lines, and the eighth terminal being coupled to the predetermined voltage.

27. The electro-optical device according to claim 22, each unit circuit of the plurality of unit circuits not including any transistor other than the first transistor, the second transistor, and the third transistor.

28. The electro-optical device according to claim 22, a conduction type of the first transistor being identical with a conduction type of the second transistor.

29. The electro-optical device according to claim 22, a threshold voltage of the first transistor not being lower than a threshold voltage of the second transistor.

30. The electro-optical device according to claim 22, the electro-optical element being an EL element.

31. The electro-optical device according to claim 22, the plurality of unit circuits including a group of unit circuits that arranged along one scanning line of the plurality of scanning lines, the group of unit circuits being used for exhibiting the same color.

32. An electronic apparatus being equipped with the electro-optical device according to claim 22.

33. The electro-optical device according to claim 22, the plurality of first power source lines intersecting the plurality of data lines.

34. The electro-optical device according to claim 22, the plurality of first power source lines being arranged along the plurality of scanning lines.

35. An electronic circuit comprising:

a plurality of unit circuits;

a first power source line; and a control circuit that sets a potential of the first power source line to a plurality of potentials or controls an electrical disconnection and an electrical connection between the first power source line and a predetermined voltage, each of the plurality of unit circuits including:

a first transistor having a first terminal, a second terminal, and a first control terminal;

a second transistor having a third terminal, a fourth terminal, and a second control terminal, the third terminal and the fourth terminal being directly connected to the first control terminal and the first power source line, respectively;

a capacitive element having a first electrode and a second electrode, the first electrode being coupled to the first control terminal; and a third transistor having a fifth terminal and a sixth terminal, the third transistor controlling an electrical connection between a data line and the second electrode.

36. An electro-optical device, the device comprising:

a plurality of data lines;

a plurality of scanning lines;

a plurality of first power source lines; and a plurality of unit circuits, each of the plurality of unit circuits including:

a first transistor having a first terminal, a second terminal, and a first control terminal;

an electro-optical element that is coupled to the first terminal;

a second transistor having a third terminal that is coupled to the first control terminal and a fourth terminal that is directly connected to one first power source line of the plurality of first power source lines;

a capacitive element having a first electrode and a second electrode, the first electrode being coupled to the first control terminal; and a third transistor having a fifth terminal that is coupled to the second electrode, a sixth terminal that is coupled to one data line of the plurality of data lines, and a third control terminal that is coupled to one scanning line of the plurality of scanning lines, a first potential of the first electrode being set to a first voltage by electrically connecting the first electrode and the power source line through the second transistor during a first period, and a second potential of the first control terminal being set to a second voltage by a data signal that is supplied to the capacitive element through the third transistor during a second period and that changes the first potential from the first voltage by a capacitance coupling involved with the capacitive element.

* * * * *